United States Patent [19]

Williamson

[11] 4,142,067

[45] Feb. 27, 1979

[54] SPEECH ANALYZER FOR ANALYZING FREQUENCY PERTURBATIONS IN A SPEECH PATTERN TO DETERMINE THE EMOTIONAL STATE OF A PERSON

[76] Inventor: John D. Williamson, P.O. Box 763, Theodore, Ala. 36582

[21] Appl. No.: 895,375

[22] Filed: Apr. 11, 1978

Related U.S. Application Data

[63] Continuation-in-part of Ser. No. 806,497, Jun. 14, 1977, Pat. No. 4,093,821.

[51] Int. Cl.[2] ..... G10L 4/00

[52] U.S. Cl. ..... 179/1 SC; 128/2 R; 179/1 MN; 179/1 SP

[58] Field of Search ..... 179/1 SC, 1 SP; 128/2.06, 2 R

[56] References Cited

U.S. PATENT DOCUMENTS 3,855,416 12/1974 Fuller ..... 179/1 SP 3,971,034 7/1976 Bell et al. ..... 179/1 SP

*Primary Examiner*—William C. Cooper

*Assistant Examiner*—E. S. Kemeny

*Attorney, Agent, or Firm*—Armstrong, Nikaido, Marmelstein & Kubovcik

[57] ABSTRACT

A speech analyzer is provided for determining the emotional state of a person by analyzing pitch or frequency perturbations in the speech pattern. The analyzer determines null points or "flat" spots in a FM demodulated speech signal and it produces an output indicative of the nulls. The output can be analyzed by the operator of the device to determine the emotional state of the person whose speech pattern is being monitored.

15 Claims, 15 Drawing Figures

SPEECH ANALYZER FOR ANALYZING FREQUENCY PERTURBATIONS IN A SPEECH PATTERN TO DETERMINE THE EMOTIONAL STATE OF A PERSON

RELATED APPLICATION

This application is a continuation-in-part application of my co-pending application Ser. No. 806,497 filed June 14, 1977, now U.S. Pat. No. 4,093,821.

BACKGROUND OF THE INVENTION

1. Field of the Invention

This invention is related to an apparatus for analysing an individual's speech and more particularly, to an apparatus for analysing pitch perturbations to determine the individual emotional state such as stress, depression, anxiety, fear, happiness, etc., which can be indicative of subjective attitudes, character, mental state, physical state, gross behavioral patterns, veracity, etc. In this regard, the apparatus has commercial applications as a criminal investigative tool, a medical and/or psychiatric diagnostic aid, a public opinion polling aid, etc.

2. Description of the Prior Art

One type of technique for speech analysis to determine emotional stress is disclosed in Bell Jr., et al., U.S. Pat. No. 3,971,034. In the technique disclosed in this patent a speech signal is processed to produce an FM demodulated speech signal. This FM demodulated signal is recorded on a chart recorder and then is manually analysed by an operator. This technique has several disadvantages. First, the output is not a real time analysis of the speech signal. Another disadvantage is that the operator must be very highly trained in order to perform a manual analysis of the FM demodulated speech signal and the analysis is a very time consuming endeavor. Still another disadvantage of the technique disclosed in Bell Jr., et al. is that it operates on the fundamental frequencies of the vocal cords and, in the Bell Jr., et al. technique tedious re-recording and special time expansion of the voice signal are required. In practice, all these factors result in an unnecessarily low sensitivity to the parameter of interest, specifically stress.

Another technique for voice analysing to determine emotional states is disclosed in Fuller, U.S. Pat. Nos. 3,855,416, 3,855,417, and 3,855,418. The technique disclosed in the Fuller patents analyses amplitude characteristics of a speech signal and operates on distortion products of the fundamental frequency commonly called vibrato and on proportional relationships between various harmonic overtone or higher order formant frequencies.

Although this technique appears to operate in real time, in practice, each voice sample must be calibrated or normalized against each individual for reliable results. Analysis is also limited to the occurrence of stress, and other characteristics of an individual's emotional state cannot be detected.

SUMMARY OF THE INVENTION

The present invention is directed to an apparatus for analysing a person's speech to determine their emotional state. The analyser operates on the real time frequency or pitch components within the first formant band of human speech. In analysing the speech, the apparatus analyses certain value occurrence patterns in terms of differential first formant pitch, rate of change of pitch, duration and time distribution patterns. These factors relate in a complex but very fundamental way to both transient and long term emotional states.

Human speech is initiated by two basic sound generating mechanisms. The vocal cords; thin stretched membranes under muscle control, oscillate when expelled air from the lungs passes through them. They produce a characteristic "buzz" sound at a fundamental frequency between 80Hz and 240 Hz. This frequency is varied over a moderate range by both conscious and unconscious muscle contraction and relaxation. The wave form of the fundamental "buzz" contains many harmonics, some of which excite resonance is various fixed and variable cavities associated with the vocal tract. The second basic sound generated during speech is a pseudo-random noise having a fairly broad and uniform frequency distribution. It is caused by turbulence as expelled air moves through the vocal tract and is called a "hiss" sound. It is modulated, for the most part, by tongue movements and also excites the fixed and variable cavities. It is this complex mixture of "buzz" and "hiss" sounds, shaped and articulated by the resonant cavities, which produces speech.

In an energy distribution analysis of speech sounds, it will be found that the energy falls into distinct frequency bands called formants. There are three significant formants. The system described here utilizes the first formant band which extends from the fundamental "buzz" frequency to approximately 1000 Hz. This band has not only the highest energy content but reflects a high degree of frequency modulation as a function of various vocal tract and facial muscle tension variations.

In effect, by analysing certain first formant frequency distribution patterns, a qualitative measure of speech related muscle tension variations and interactions is performed. Since these muscles are predominantly biased and articulated through secondary unconscious processes which are in turn influenced by emotional state, a relative measure of emotional activity can be determined independent of a person's awareness or lack of awareness of that state. Research also bears out a general supposition that since the mechanisms of speech are exceedingly complex and largely autonomous, very few people are able to consciously "project" a fictitious emotional state. In fact, an attempt to do so usually generates its own unique psychological stress "fingerprint" in the voice pattern.

Because of the characteristics of the first formant speech sounds, the present invention analyses an FM demodulated first formant speech signal and produces an output indicative of nulls thereof.

The frequency or number of nulls or "flat" spots in the FM demodulated signal, the length of the nulls and the ratio of the total time that nulls exist during a word period to the overall time of the word period are all indicative of the emotional state of the individual. By looking at the output of the device, the user can see or feel the occurrence of the nulls and thus can determine by observing the output the number or frequency of nulls, the length of the nulls and the ratio of the total time nulls exist during a word period to the length of the word period, the emotional state of the individual.

In the present invention, the first formant frequency band of a speech signal is FM demodulated and the FM demodulated signal is applied to a word detector circuit which detects the presence of an FM demodulated signal. The FM demodulated signal is also applied to a null detector means which detects the nulls in the FM demodulated signal and produces an output indicative thereof. An output circuit is coupled to the word detector and to the null detector. The output circuit is enabled by the word detector when the word detector detects the presence of an FM demodulated signal, and the output circuit produces an output indicative of the presence or non-presence of a null in the FM demodulated signal. The output of the output circuit is displayed in a manner in which it can be perceived by a user so that the user is provided with an indication of the existence of nulls in the FM demodulated signal.

The user of the device thus monitors the nulls and can thereby determine the emotional state of the individual whose speech is being analysed.

It is an object of the present invention to provide a method and apparatus for analysing an individual's speech pattern to determine his or her emotional state.

It is another object of the present invention to provide a method and apparatus for analysing an individual's speech to determine the individual's emotional state in real time.

It is still another object of the present invention to analyse an individual's speech to determine the individual's emotional state by analysing frequency or pitch perturbations of the individual's speech.

It is still a further object of the present invention to analyse an FM demodulated first formant speech signal to monitor the occurrence of nulls therein.

It is still another object of the present invention to provide a small portable speech analyser for analysing an individual's speech pattern to determine their emotional state.

BRIEF DESCRIPTION OF THE DRAWINGS

FIGS. 2A–2K illustrate the electrical signals produced by the system shown in FIG. 1.

DETAILED DESCRIPTION OF THE PREFERRED EMBODIMENT

Figure 1:
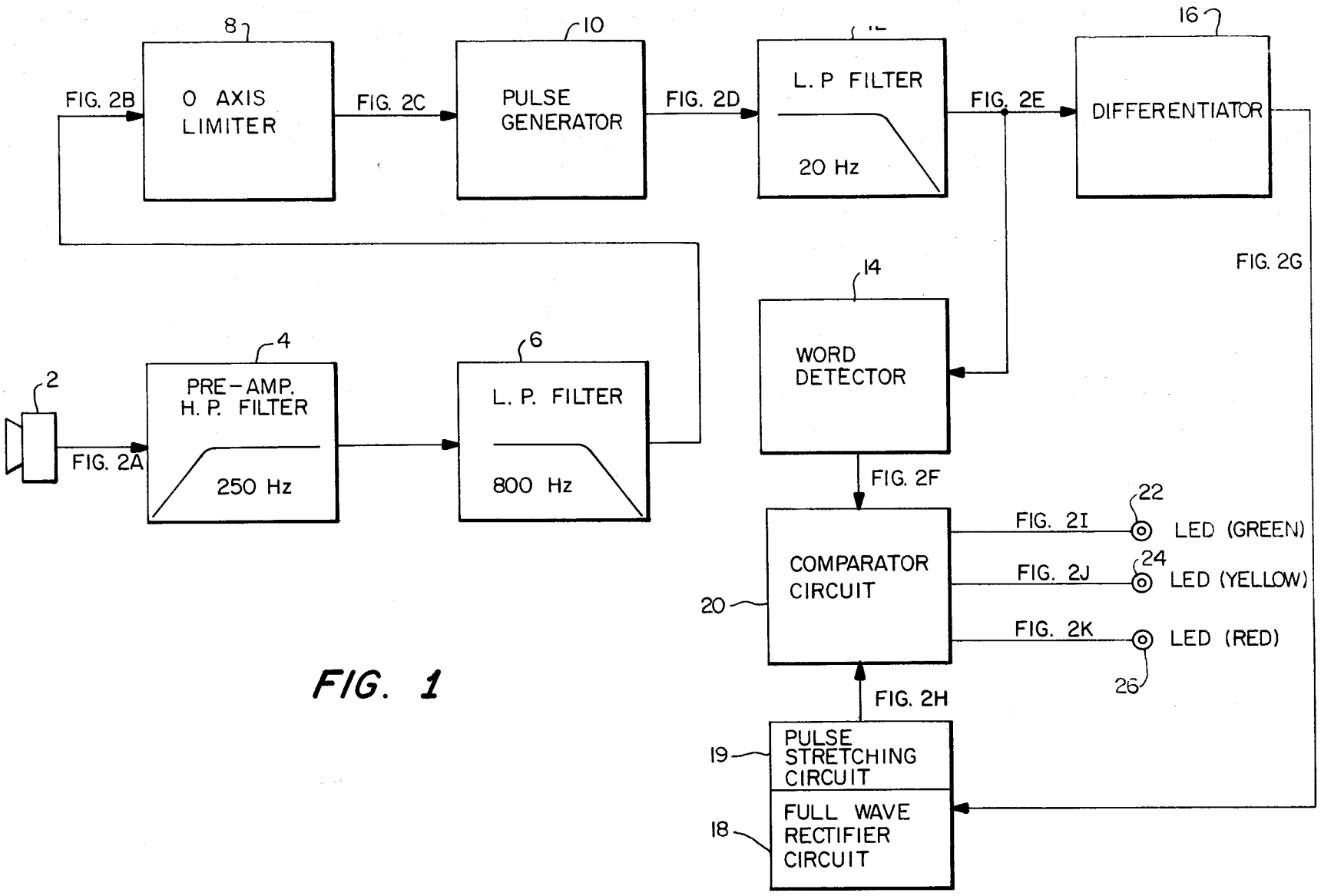
FIG. 1 is a block diagram of the system of the present invention.
Figures 2A, 2B, 2C, 2D:
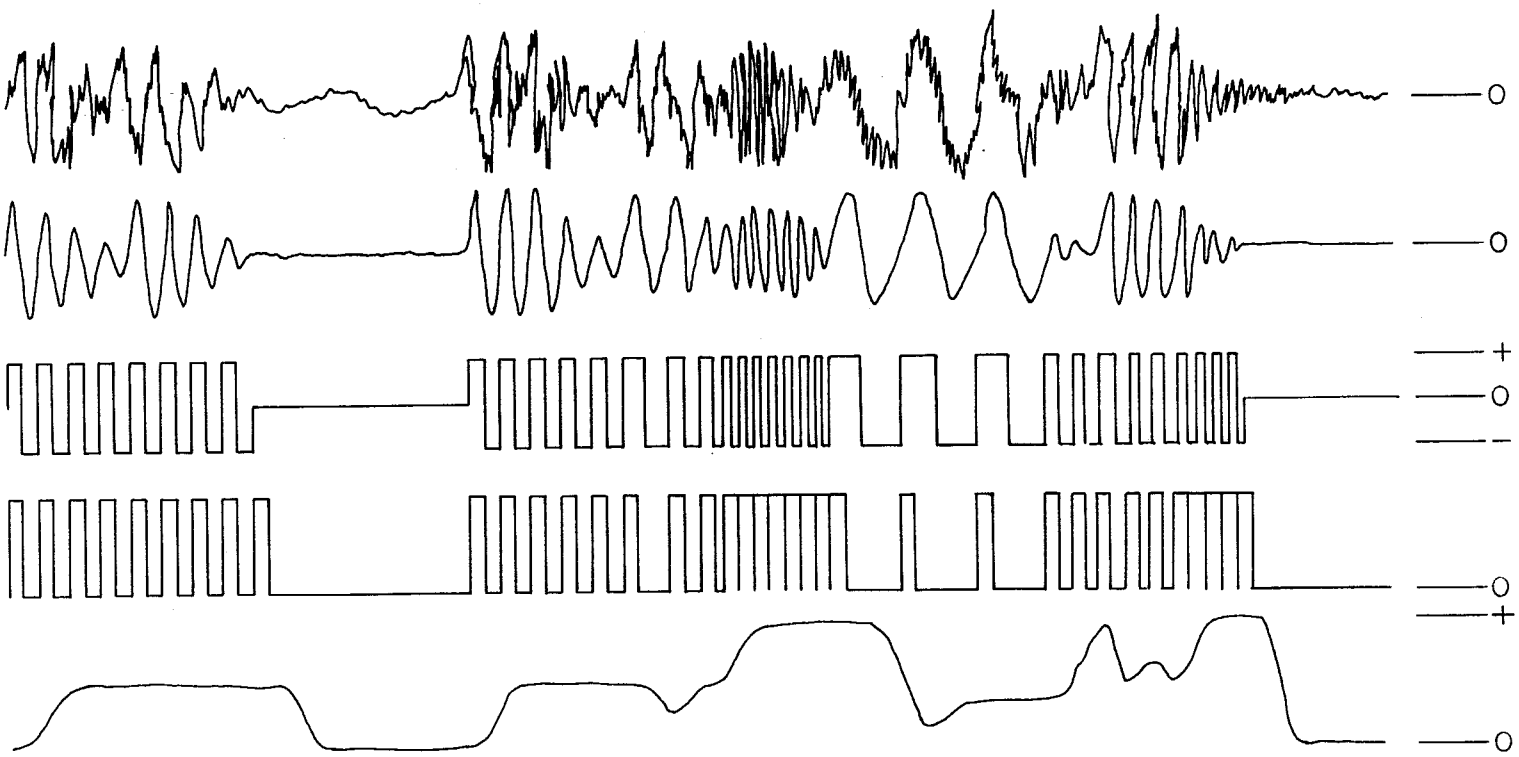

Referring to FIGS. 1 and 2A–2K, speech, for the purposes of convenience, is introduced into the speech analyser by means of a built-in microphone 2. The low level signal from the microphone 2 shown in FIG. 2A is amplified by the preamplifier 4 which also removes the low frequency components of the signal by means of a high pass filter section. The amplified speech signal is then passed through the low pass filter 6 which removes the high frequency components above the first formant band. The resultant signal, illustrated in FIG. 2B represents the frequency components to be found in the first formant band of speech, the first formant band being 250Hz–800 Hz. The signal from low pass filter 6 is then passed through the zero axis limiter circuit 8 which removes all amplitude variations and produces a uniform square wave output illustrated in FIG. 2C which contains only the period or instantaneous frequency component of the first formant speech signal. This signal is then applied to the pulse generator circuit 10 which produces an output pulse of constant amplitude and width, hence constant energy, upon each positive going transition of the input signal. The output of pulse generator circuit 10 is illustrated in FIG. 2D. The pulse signal in FIG. 2D is integrated by the low pass filter circuit 12 whose output is shown in FIG. 2E and 2E2. The D.C. level or amplitude of the output of the filter as shown in FIG. 2E thus represents the instantaneous frequency of the first formant speech signal. The output of the low pass filter 12 will thus vary as a function of the frequency modulation of the first formant speech signal by various vocal cord and other vocal tract muscle systems. The overall combination of the zero axis limiter 8, the pulse generator 10, and the low pass filter 12 comprise a conventional FM demodulator designed to operate over the first formant speech frequency band.

Figures 2F, 2G, 2H, 2I, 2J, 2K:
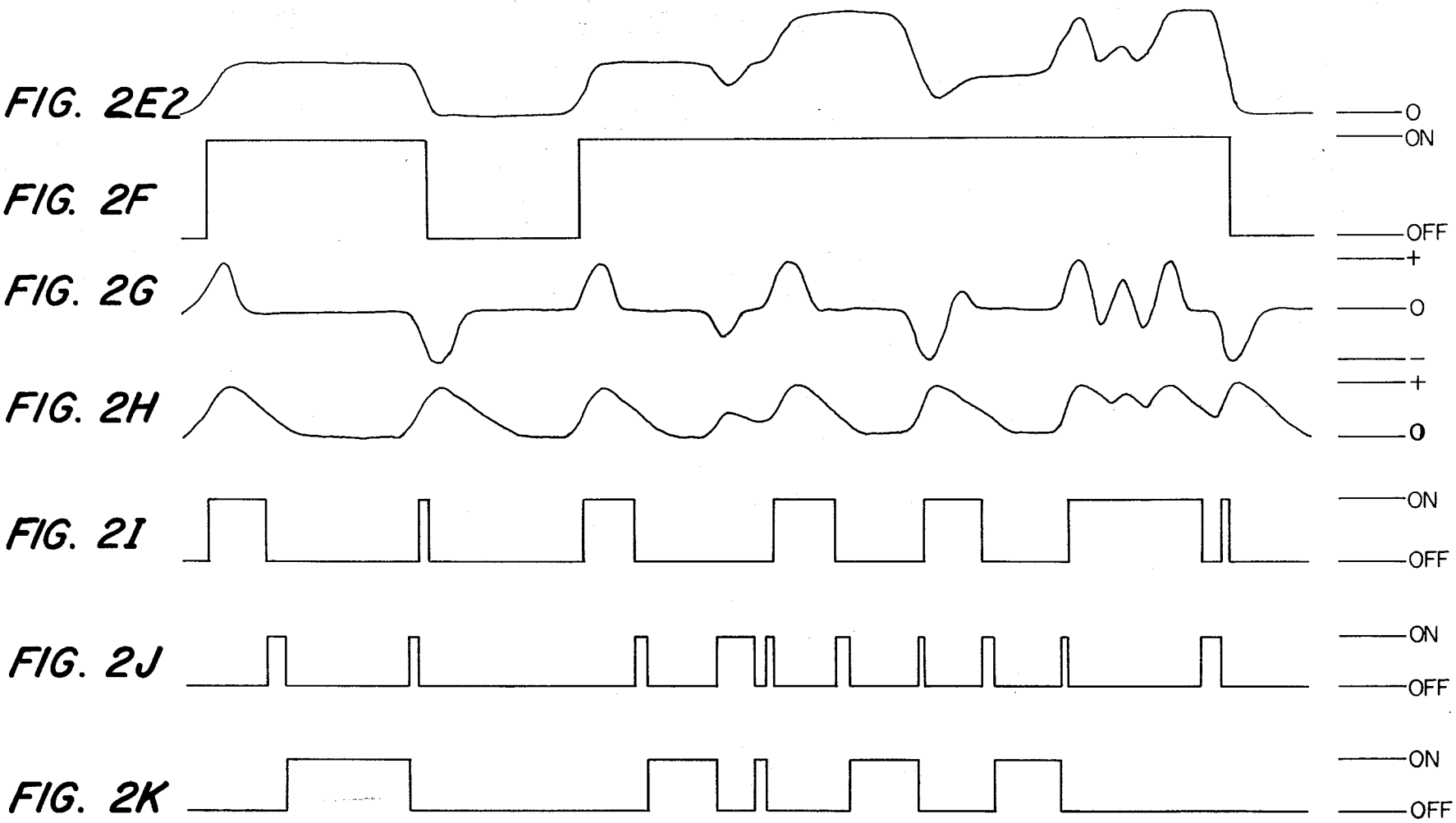

The FM demodulated output signal from the low pass filter 12 is applied to word detector circuit 14 which is a voltage comparator with a reference voltage set to a level representative of a first formant frequency of 250 Hz. When this reference level is exceeded by the FM demodulated signal, the comparator output switches from OFF to ON as illustrated in FIG. 2F.

The FM demodulated signal from the low pass filter 12 is also applied to differentiator circuit 16 which produces an output signal proportional to the instantaneous rate of change of frequency of the first formant speech signal. The output of differentiator 16, which is shown in FIG. 2G, corresponds to the degree of frequency modulation of the first formant speech signal.

The signal from differentiator 16 is applied to a full wave rectifier circuit 18. This circuit passes the positive portion of the signal unchanged. The negative portion is inverted and added to the positive portion. The composite signal is then applied to pulse stretching circuit 19 which comprises a parallel circuit of a resistor and capacitor in series with a diode. The pulse stretching circuit 19 provides a fast rise, slow delay function which eliminates false null information as the differentiated signal passes through zero. The output of null detector 18 is illustrated in FIG. 2H.

The output signal of the pulse stretching circuit 19 is applied to comparator circuit 20 which comprises a three level voltage comparator gated ON or OFF by the output of word detector circuit 14. Thus, when speech is present, the comparator circuit 20 evaluates, in terms of amplitude level, the output of the pulse stretching circuit 19. Reference levels of the comparator circuit 20 are set so that when normal levels of frequency modulation are present in the first formant speech signal an output as shown in FIG. 2I is produced and an appropriate visual indicator, such as a green LED 22 is turned ON. When there is only a small amount of frequency modulation present, such as under mild stress conditions, an output such as shown in FIG. 2J is produced and the comparator circuit 20 turns on the yellow LED 24. When there is a full null, such as produced by more intense stress conditions, an output such as shown in FIG. 2K is produced and the comparator circuit turns on the red LED 26.

Figure 3:
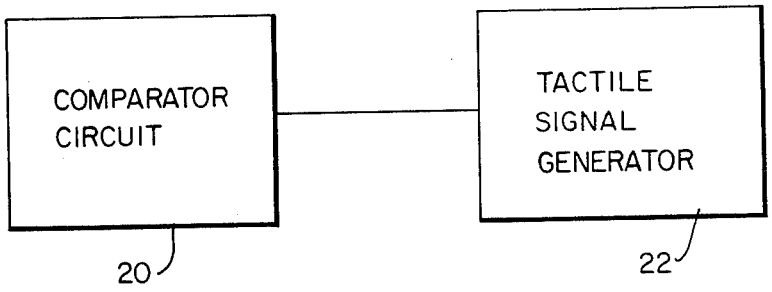
FIG. 3 illustrates an alternative embodiment of the output of the present invention.

Referring to FIG. 3, comparator circuit 20 can have an output coupled to a tactile device 28 for producing a tactile output so that the user can place the device close to his body and sense the occurrence of nulls through a physical stimulation to his body rather than through a visual display. In this embodiment the user can maintain eye contact with the individual whose speech is being analysed which could in turn reduce the anxiety of the individual whose speech is being analysed, which is caused by the user constantly looking to the speech analyser.

Figure 4:
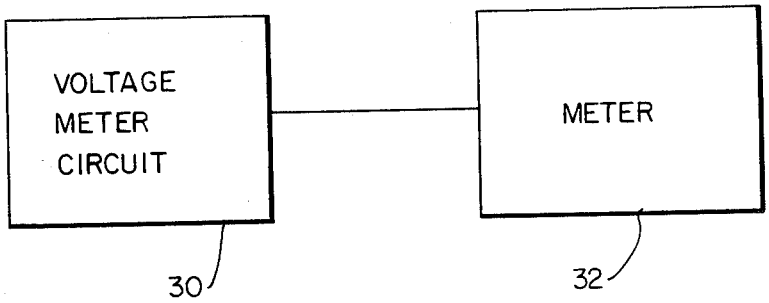
FIG. 4 illustrates still another alternative embodiment of the output of the present invention.

In the embodiment shown in FIG. 4 the word detector 14 and the pulse stretching circuit 19 are connected to a voltage meter circuit 30 which is substituted for the comparator circuit 20. The meter circuit 30 is turned on when word detector 14 is ON and meter 32 provides an indication of the voltage output of pulse stretching circuit 19.

Since the pitch or frequency null perturbations contained within the first formant speech signal define, by their pattern of occurrence, certain emotional states of the individual whose speech is being analysed, a visual integration and interpretation of the displayed output provides adequate information to the user of the instrument for making certain decisions with regard to the emotional state, in real time, of the person speaking.

The speech analyser of the present invention can be constructed using integrated circuits and therefore can be constructed in a very small size which allows it to be portable and capable of being carried in one's pocket, for example.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are therefore, to be embraced therein.

I claim:

1. A speech analyser for determining the emotional state of a person, said analyser comprising:

(a) FM demodulator means for detecting a person's speech and producing an FM demodulated signal therefrom;

(b) word detector means coupled to the output of said FM demodulator means for detecting the presence of an FM demodulated signal;

(c) null detector means coupled to the output of said FM demodulator means for detecting nulls in the FM demodulated signal and for producing an output indicative thereof;

(d) output means coupled to said word detector means and said null detector means, wherein said output means is enabled by said word detector means when said word detector means detects the presence of an FM demodulated signal and wherein said output means produces an output indicative of the presence or nonpresence of a null in the FM demodulated signal.

2. A speech analyser as set forth in claim 1 wherein said null detector means comprises:

(a) a differentiator means for differentiating the FM demodulated signal;

(b) a full wave rectifier means, for rectifying the FM demodulated signal; and (c) pulse stretching circuit means for eliminating the detection of a null when the differentiated FM demodulated signal passes through zero.

3. A speech analyser as set forth in claim 1 wherein said output means comprises:

(a) comparator means for detecting the level of the ouptut of the null detector means and comparing the level with predetermined voltage levels wherein when said level is below a first predetermined level a null exists and when said level is above a second predetermined level a null does not exist; and (b) display means for displaying the output of said comparator means.

4. A speech analyser as set forth in claim 3 wherein said display means comprises at least two lights one of said lights being turned on when the output of the comparator means is indicative of a null and the other light being turned on when the output of the comparator means is indicative of the non-existence of a null.

5. A speech analyser as set forth in claim 4 wherein said display means further includes a third light said third light being turned on when the level of the output of the level detector means is indicative of a transition between the existence and non-existence of a null.

6. A speech analyser as set forth in claim 1 wherein said output means is a voltage meter means.

7. A speech analyser as set forth in claim 3 wherein said display means is a tactile display.

8. A speech analyser as set forth in claim 1 wherein said FM demodulator means includes filter means for passing signals in the range of 250Hz to 800Hz.

9. A speech analyser for analysing an FM demodulated speech signal said analyser comprising:

(a) word detector means for detecting the presence of an FM demodulated signal;

(b) null detector means for detecting nulls in the FM demodulated signal and for producing an output indicative thereof; and (c) output means coupled to said word detector means and said null detector means, wherein said output means is enabled by said word detector means when said word detector means detects the presence of an FM demodulated signal and wherein said output means produces an output indicative of the presence or non-presence of a null in the FM demodulated signal.

10. A speech analyser as set forth in claim 9 wherein said null detector means comprises:

(a) a differentiator means for differentiating the FM demodulated signal;

(b) a full wave rectifier means, for rectifying the FM demodulated signal; and (c) pulse stretching circuit means for eliminating the detection of a null when the differentiated FM demodulated signal passes through zero.

11. A speech analyser as set forth in claim 9 wherein said display means comprises at least two lights one of said lights being turned on when the output of the comparator means is indicative of a null and the other light being turned on when the output of the comparator means is indicative of the non-existence of a null.

12. A speech analyser as set forth in claim 9 wherein said display means comprises at least two lights one of said lights being turned on when the output of the comparator means is indicative of a null and the other light being turned on when the output of the comparator means is indicative of the non-existence of a null.

13. A speech analyser as set forth in claim 9 wherein said display means further includes a third light said third light being turned on when the level of the output of the level detector means is indicative of a transition between the existence and non-existence of a null.

14. A speech analyser as set forth in claim 9 wherein said display means is a meter.

15. A speech analyser as set forth in claim 9 wherein said display means is a tactile display.

* * * * *